US007843442B2

(12) United States Patent
Choi et al.

(10) Patent No.: US 7,843,442 B2
(45) Date of Patent: Nov. 30, 2010

(54) PIXEL AND ORGANIC LIGHT EMITTING DISPLAY USING THE PIXEL

(75) Inventors: Sang Moo Choi, Suwon (KR); Oh Kyong Kwon, Seoul (KR)

(73) Assignee: Samsung Mobile Display Co., Ltd. (KR)

( * ) Notice: Subject to any disclaimer, the term of this patent is extended or adjusted under 35 U.S.C. 154(b) by 1095 days.

(21) Appl. No.: 11/377,981

(22) Filed: Mar. 17, 2006

(65) Prior Publication Data

US 2006/0232678 A1 Oct. 19, 2006

(30) Foreign Application Priority Data

Mar. 19, 2005 (KR) ..... 10-2005-22971

(51) Int. Cl.
*G09G 5/00* (2006.01)

(52) U.S. Cl. ..... 345/204; 345/76; 345/92; 327/94; 341/136

(58) Field of Classification Search ..... 345/76, 345/92, 204; 327/94; 341/136
See application file for complete search history.

(56) References Cited

U.S. PATENT DOCUMENTS

| | | | | |
|---|---|---|---|---|
| 2002/0190971 | A1* | 12/2002 | Nakamura et al. | 345/204 |
| 2003/0006955 | A1* | 1/2003 | Tsuchi | 345/92 |
| 2003/0034806 | A1* | 2/2003 | Azami | 327/94 |
| 2003/1003480 | | 2/2003 | Azami | |
| 2004/0174282 | A1* | 9/2004 | Sun et al. | 341/136 |
| 2004/0233141 | A1* | 11/2004 | Matsumoto | 345/76 |
| 2005/0007361 | A1* | 1/2005 | Fujikura et al. | 345/204 |
| 2005/0099412 | A1 | 5/2005 | Kasai | |
| 2005/0140598 | A1* | 6/2005 | Kim et al. | 345/76 |

FOREIGN PATENT DOCUMENTS

| | | |
|---|---|---|
| JP | 2003-173165 | 6/2003 |
| JP | 2003-177709 | 6/2003 |
| JP | 2004-133240 | 4/2004 |
| JP | 2004-226960 | 8/2004 |
| JP | 2004-318093 | 11/2004 |
| JP | 2005-196116 | 7/2005 |
| KR | 1020040088371 A | 10/2004 |

OTHER PUBLICATIONS

Japanese Office Action issued on Aug. 5, 2008 by the Japanese Patent Office in Japanese Patent Application No. 2005-268798.
Office Action issued by Korean Patent Office dated Aug. 31, 2006.

* cited by examiner

*Primary Examiner*—Amare Mengistu
*Assistant Examiner*—Premal Patel
(74) *Attorney, Agent, or Firm*—Knobbe, Martens, Olson & Bear LLP

(57) ABSTRACT

A pixel and an organic light emitting display using the pixel capable of displaying an image of uniform luminance. A pixel circuit is coupled with at least one scan line and at least one data line. The pixel circuit first charges a voltage corresponding to a first data signal across at least one capacitor when the first data signal is supplied from the data lines, and second charges the at least one capacitor when a current as a second data signal is provided. The pixel circuit controls an amount of current supplied to a second power supply from the first power supply through the organic light emitting diode according to the voltage charged in the at least one capacitor. Accordingly, an image of uniform luminescence may be displayed.

11 Claims, 7 Drawing Sheets

PIXEL AND ORGANIC LIGHT EMITTING DISPLAY USING THE PIXEL

CROSS-REFERENCE TO RELATED APPLICATIONS

This application claims the benefit of Korean Patent Application No. 2005-22971, filed on Mar. 19, 2005, in the Korean Intellectual Property Office, the disclosure of which is incorporated herein by reference.

BACKGROUND OF THE INVENTION

1. Field of the Invention

The present invention relates to a pixel and a organic light emitting display using the pixel, and more particularly to a pixel and a organic light emitting display using the pixel capable of displaying an image of uniform luminance.

2. Description of the Related Technology

Recently, various flat panel displays have been developed, which substitute for a Cathode Ray Tube (CRT) display because the CRT display is relatively heavy and bulky. Flat panel displays include Liquid Crystal Displays (LCDs), Field Emission Displays (FEDs), Plasma Display Panels (PDPs), Organic Light Emitting Displays, etc An organic light emitting display displays an image using an organic light emitting diode that generates light by the recombination of electrons and holes. Such an organic light emitting display has advantages in that it has a high response speed, and operates with low power consumption.

FIG. 1 is a view showing a conventional organic light emitting display. With reference to FIG. 1, the conventional organic light emitting display includes a pixel portion 30, a scan driver 10, a data driver 20, and a timing controller 50. The pixel portion 30 includes a plurality of pixels coupled with scan lines S1 to Sn and data lines D1 to Dm. The scan driver 10 drives the scan lines S1 to Sn. The data driver 20 drives the data lines D1 to Dm. The timing controller 50 controls the scan driver 10 and the data driver 20.

The timing controller 50 generates a data drive control signal DCS and a scan drive control signal SCS according to externally supplied synchronous signals. The data drive control signal DCS generated by the timing controller 50 is provided to the data driver 20, and the scan drive control signal SCS is provided to the scan driver 10. Furthermore, the timing controller 50 provides externally supplied data Data to the data driver 20.

The scan driver 10 receives the scan drive control signal SCS from the timing controller 50. Upon the receipt of the scan drive control signal SCS, the scan driver generates a scan signal, and sequentially provides the generated scan signal to the scan lines S1 to Sn.

The data driver 20 receives the data drive control signal DCS from the timing controller 50. Upon the receipt of the data drive control signal DCS, the data driver 20 generates a data signal (predetermined voltage), and provides the generated data signal to the data lines D1 to Dm in synchronism with the scan signal.

The pixel portion 30 receives a first power supply ELVDD and a second power supply ELVSS from an exterior source, and provides them to individual pixels 40. Upon the receipt of the first power supply ELVDD and the second power supply ELVSS, the pixels 40 control an amount of current to the second power supply ELVSS from the first power supply ELVDD through an organic light emitting diode corresponding to the data signal, thus generating light corresponding to the data signal.

That is, in the conventional organic light emitting display, each of the pixels 40 generates light of a predetermined luminance corresponding to the data signal applied to that pixel. However, due to non-uniformity of threshold voltages and a deviation of electron mobility of transistors included in each pixel 40, the conventional organic light emitting display can not display an image of a uniform luminance. In order to solve this problem, an electric current can be supplied as a data signal. In practice, when the electric current is supplied as the data signal, even though the transistors have non-uniform voltage-current characteristics, the pixel can display an image of uniform luminance at the pixel portion 30. However, because the current supplied as the data signal is a minute current, it takes a long time to charge a data line. For example, assuming that a load capacitance of the data line is 30 pF, a time of several ms is required to charge the load of the data line with a data signal from several tens nA to several hundreds nA. Upon considering one horizontal period of several tens μs, there is a problem in that the required charge time exceeds the scan time, thus not allowing sufficient time to charge the date line.

SUMMARY OF CERTAIN INVENTIVE ASPECTS

Accordingly, it is an aspect of the present invention to provide a pixel and a organic light emitting display using the pixel capable of displaying an image of uniform luminance.

One embodiment has a pixel including an organic light emitting diode, and a pixel circuit electrically connected to at least one scan line and at least one data line, the pixel circuit including a capacitor, where the scan line and the data line are configured to charge the capacitor in response to the first data signal with a voltage corresponding to a difference between a first power supply and a first data signal and to charge the capacitor with a voltage corresponding to a current signal, where the pixel circuit is configured to control the amount of current supplied to a second power supply from the first power supply through the organic light emitting diode according to the voltage stored in the capacitor.

Another embodiment has an organic light emitting display, including a plurality of pixels, a scan driver configured to supply a scan signal to scan lines, and at least one data driving circuit configured to supply a first data signal during a first period of at least one horizontal period, the first data signal being supplied through data lines to the pixels selected by the scan signal. The driving circuit is further configured to provide a current as a second data signal to the pixels during a second period different from the first period, where each of the pixels include an organic light emitting diode. The driving circuit also includes a pixel circuit electrically connected to at least one of the scan lines and to at least one of the data lines, the pixel circuit including a capacitor, where the scan line and the data line are configured to charge the capacitor in response to the first data signal with a voltage corresponding to a difference between a first power supply and a first data signal and to charge the capacitor with a voltage corresponding to, and in response to, a current signal, where the pixel circuit is configured to control the amount of current supplied to a second power supply from the first power supply through the organic light emitting diode according to the voltage charged across the capacitor.

Another embodiment is a method of manufacturing a pixel. The method includes forming an organic light emitting diode, and forming a pixel circuit electrically connected to at least one scan line and to at least one data line, the pixel circuit including a capacitor, where the scan line and the data line are configured to charge the capacitor in response to the first data signal with a voltage corresponding to a difference between a first power supply and a first data signal in and to charge the capacitor with a voltage corresponding to a current signal in response to the current signal, where the pixel circuit is configured to control an amount of current supplied to a second power supply from the first power supply through the organic light emitting diode according to the voltage charged across the capacitor.

Another embodiment is a pixel including an organic light emitting diode, and a pixel circuit configured to control an amount of current supplied to a second power supply from the first power supply through the organic light emitting diode according to a voltage stored in the pixel circuit, where the pixel circuit is configured to receive a voltage data signal and a current data signal and to generate the voltage stored in the pixel circuit based on the current data signal.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF CERTAIN INVENTIVE EMBODIMENTS

Figure 1:
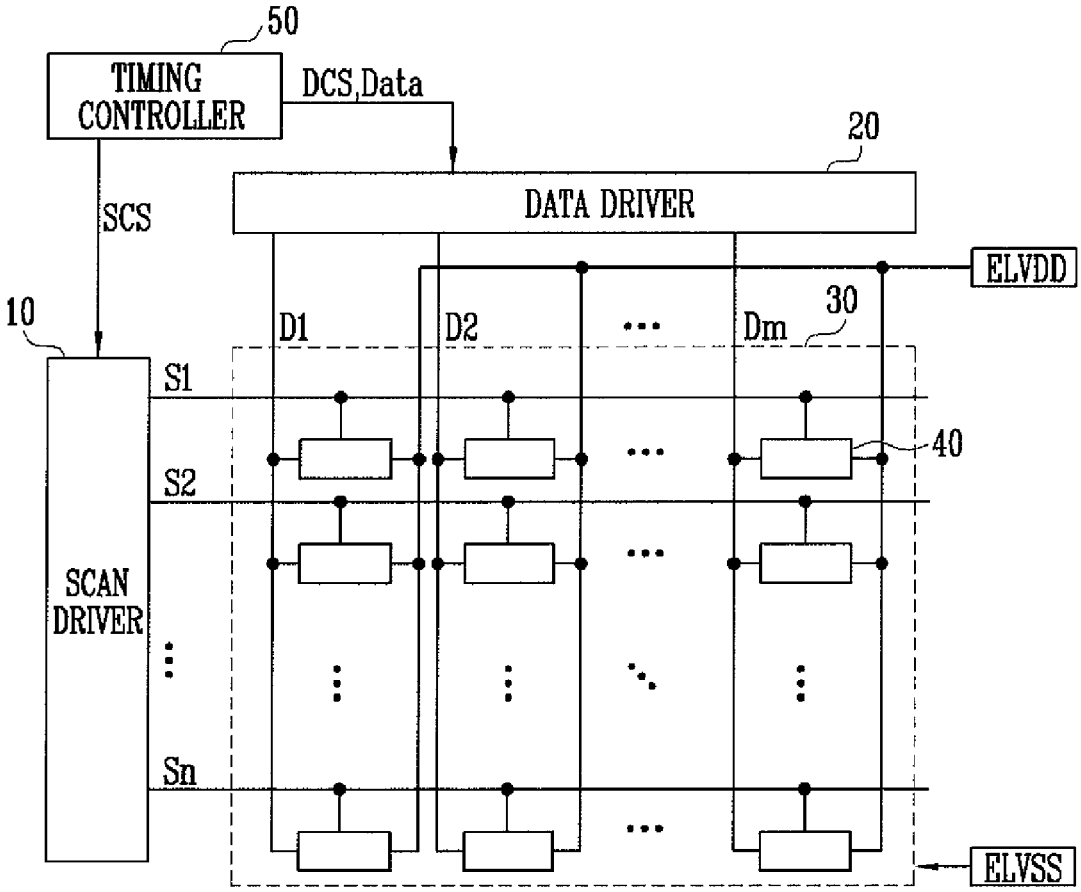
FIG. 1 (Prior Art)
FIG. 1 is a schematic view showing a conventional organic light emitting display.

Hereinafter, certain inventive embodiments will be described with reference to the accompanying drawings. Herein, when a first element is connected to a second element, the first element may be not only directly connected to the second element but may also be indirectly connected to the second element via a third element. Furthermore, some elements are omitted for clarity. Also, like reference numerals refer to like elements throughout.

Figure 2:
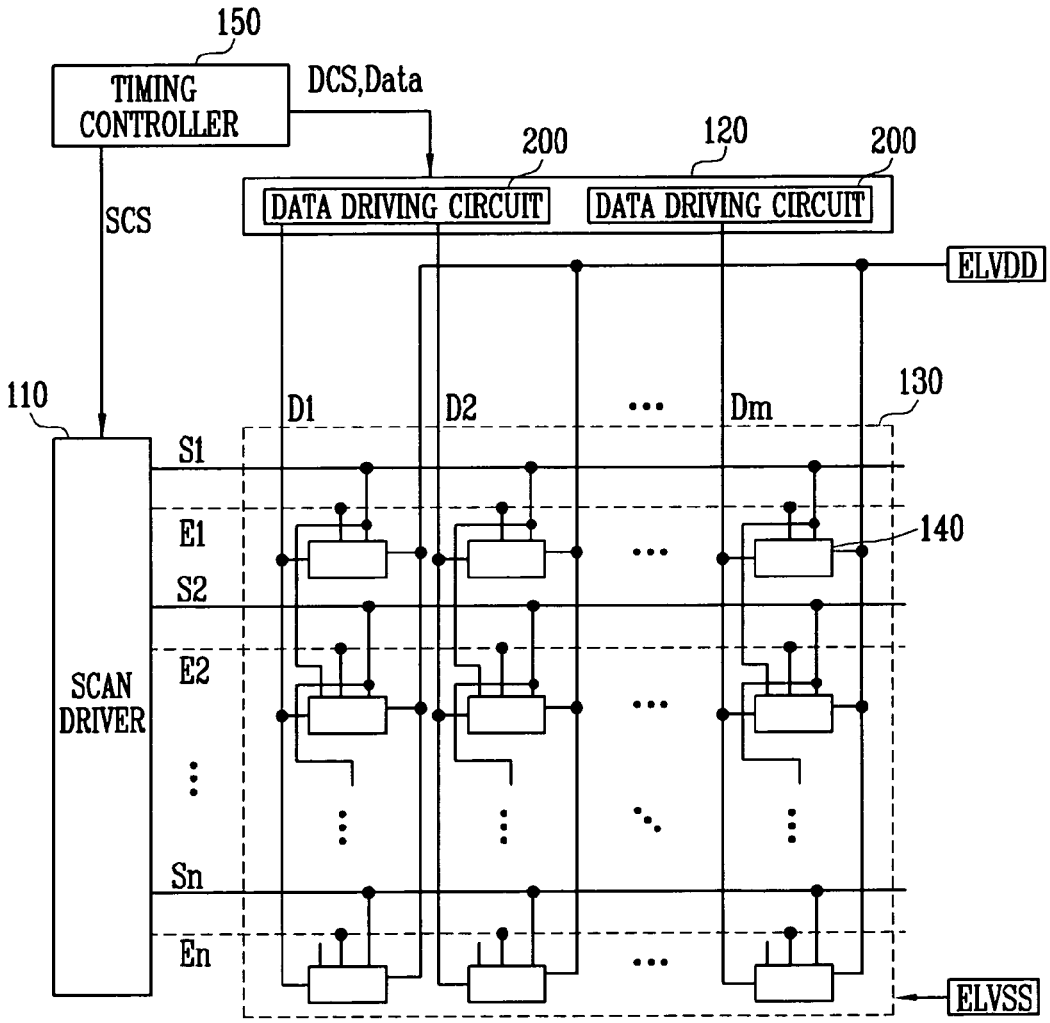
FIG. 2 is a schematic view showing a organic light emitting display according to one embodiment.

FIG. 2 is a schematic view showing an organic light emitting display according to one embodiment. With reference to FIG. 2, the organic light emitting display includes a pixel portion 130, a scan driver 110, a data driver 120, and a timing controller 150. The pixel portion 130 includes a plurality of pixels 140 that are coupled with scan lines S1 to Sn, light emission control lines E1 to En, and data lines D1 to Dm. The scan driver 110 drives the scan lines S1 to Sn, and the light emission control lines E1 to En. The data driver 120 drives the data lines D1 to Dm. The timing controller 150 controls the scan driver 110 and the data driver 120.

Figure 3:
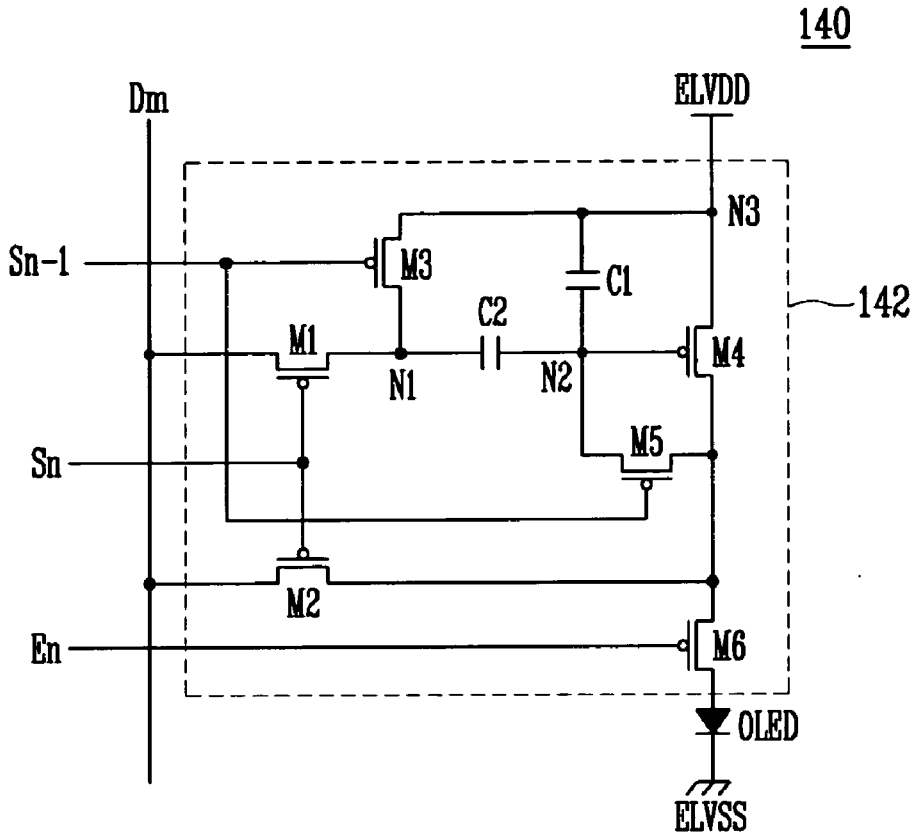
FIG. 3 is a circuit diagram showing an example of the pixel shown in FIG. 2.

The pixel portion 130 has pixels 140 that are formed at an area divided by the scan lines S1 to Sn, the light emission control lines E1 to En, and the data lines D1 to Dm. Each of the pixels 140 receives a first power supply EVVDD and a second power supply ELVSS from an exterior source. When functioning, each pixel 140 charges a voltage corresponding to a difference between a data signal and the first power supply EVVDD across at least one capacitor. Also, each pixel 140 controls an amount of current from the first power supply EVVDD to the second power supply ELVSS through a organic light emitting diode OLED according to the voltage charged in the at least one capacitor. In order to do this, each pixel 140 has a construction as shown in FIG. 3, which will be described below.

The timing controller 150 generates a data drive control signal DCS and a scan drive control signal SCS corresponding to externally supplied timing signals. The data drive control signal DCS and the scan drive control signal SCS generated by the timing controller 150 are provided to the data driver 120 and the scan driver 110, respectively. Furthermore, the timing controller 150 provides externally supplied data Data to the data driver 120.

When the scan driver 110 receives the scan drive control signal SCS from the timing controller 150, it sequentially provides a scan signal to the scan lines S1 to Sn. Moreover, when the scan driver 110 receives the scan drive control signal SCS from the timing controller 150, it sequentially provides a light emission control signal to the light emission control lines E1 to En. Here, the light emission control signal is supplied so as to overlap with two scan signals. For this purpose, the width of the light emission control signal is set to be identical with or greater than the scan signal.

The data driver 120 receives the data drive control signal DCS from the timing controller 150. After receipt of the data drive control signal DCS, the data driver 120 generates the data signal, and provides the data signal to the data lines D1 to Dm. The data driver 120 supplies a voltage (referred to as "voltage data signal" hereinafter) as a first data signal during a first period in one horizontal period 1H. In contrast to this, the data driver 120 receives a current (referred to as "current data signal" hereinafter) as a second data signal from the pixel 140 during a second period. In order to do this, the data driver 120 includes at least one data driving circuit 200. A more detailed construction of the data driving circuit 200 will be explained later.

FIG. 3 is a circuit diagram showing an example of the pixel shown in FIG. 2. FIG. 3 shows a pixel coupled with an m-th data line Dm, an n−1th scan line Sn−1, an n-th scan line Sn, and an n-th light emission control line En. The pixel includes a organic light emitting diode OLED and a pixel circuit 142 configured to supply a current to the organic light emitting diode OLED. The organic light emitting diode OLED generates red, green, or blue light with luminance corresponding to the current from the pixel circuit 142.

The pixel circuit 142 controls the amount of current from the first power supply ELVDD to the second power supply ELVSS through the organic light emitting diode OLED according to a data signal supplied from the data line Dm. So as to perform this function, the pixel circuit 142 includes first through sixth transistors M1 through M6, and first and second capacitors C1 and C2.

A first electrode of the first transistor M1 is coupled with the data line Dm, and a second electrode thereof is coupled with a first node N1. A gate electrode of the first transistor M1 is coupled with an n-th scan line Sn. When a scan signal is supplied to the n-th scan line Sn, the first transistor M1 is turned on to electrically connect the data line Dm to the first node N1. As the first transistor M1 is turned on, a voltage data signal from the data line Dm is provided to the first node N1.

A first electrode of the second transistor M2 is coupled with the data line Dm, and a second electrode thereof is coupled with a second electrode of the fourth transistor M4. A gate electrode of the second transistor M2 is coupled with the n-th scan line Sn. When a scan signal is supplied to the n-th scan line Sn, the second transistor M2 is turned on to electrically connect the second electrode of the fourth transistor M4 to the data line Dm. As the second transistor M2 is turned on, a predetermined current is provided to the data driving circuit 200.

A first electrode of the third transistor M3 is coupled with the first power supply ELVDD, and a second electrode thereof is coupled with the first node N1. A gate electrode of the third transistor M3 is coupled with an (n−1)th scan line S−1. When the scan signal is supplied to an (n−1) th scan line S−1, the third transistor M3 is turned on to electrically connect the first power supply ELVDD to the first node N1.

A first electrode of the fourth transistor M4 is coupled with the first power supply ELVDD, and a second electrode thereof is coupled with a first electrode of the sixth transistor M6. A gate electrode of the fourth transistor M4 is coupled with the second node N2. The fourth transistor M4 provides a current corresponding to a voltage applied to the second node N2 to the first electrode of the sixth transistor M6. The voltage applied to the second node N2 corresponds to the voltage charged across the first and second capacitors C1 and C2.

A first electrode of the fifth transistor M5 is coupled with the second electrode of the fourth transistor M4, and a second electrode thereof is coupled with the second node N2. A gate electrode of the fifth transistor M5 is coupled with the (n−1)th scan line Sn−1. When the scan signal is supplied to the (n−1) th scan line Sn−1, the fifth transistor M5 is turned on, causing the fourth transistor M4 to be diode-connected.

A first electrode of the sixth transistor M6 is coupled with the second electrode of the fourth transistor M4, and a second electrode thereof is coupled with an anode electrode of the organic light emitting diode OLED. A gate electrode of the sixth transistor M6 is coupled with an n-th light emission control line En. When a light emission control signal is supplied to the n-th light emission control line En, the sixth transistor M6 is turned off, whereas when the light emission control signal is not supplied to the n-th light emission control line En, the sixth transistor M6 is turned on. The light emission control signal supplied to the n-th light emission control line En overlaps with the scan signal supplied to the (n−1)-th scan line Sn−1and the n-th scan line Sn. Accordingly, when the scan signal is supplied to the (n−1)-th scan line Sn−1 and the n-th scan line Sn and a data related voltage is charged in the first and second capacitors C1 and C2, the sixth transistor M6 is turned off. In other cases, the sixth transistor M6 is turned on to electrically connect the fourth transistor M4 with the organic light emitting diode OLED. In FIG. 3, although PMOS transistors M1 through M6 are shown, the types of each of the transistors is not limited thereto, but can be changed.

Figure 4:
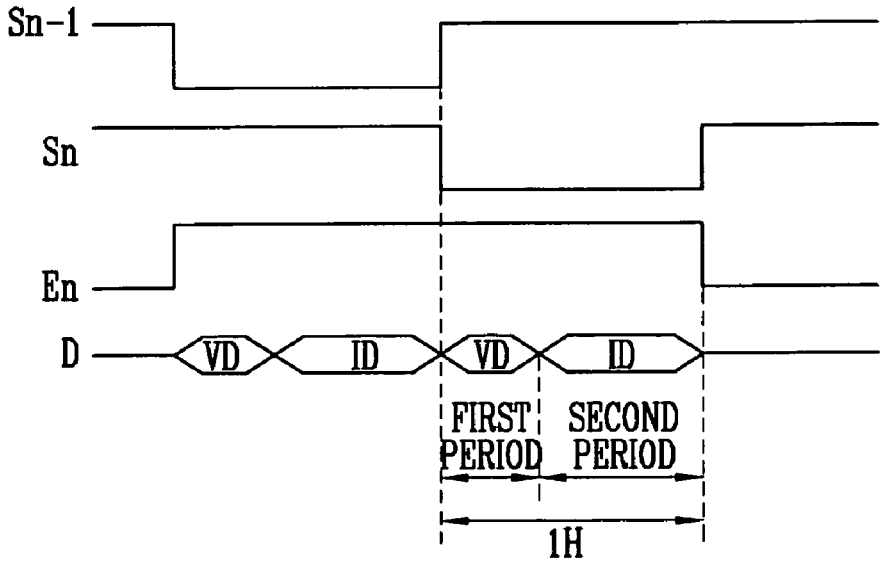
FIG. 4 is a timing chart for illustrating a method of driving the pixel shown in FIG. 3.

FIG. 4 is a timing chart for illustrating a method of driving the pixel shown in FIG. 3. In FIG. 4, a horizontal period 1H is divided into first and second periods. During the first period, a voltage data signal VD is supplied to the data lines D1 to Dm. During the second period, a current data signal ID is supplied (as a current sink) to the data lines D1 to Dm.

Referring to FIG. 3 and FIG. 4, a scan signal is supplied to the n-th scan line Sn−1 prior to the horizontal period 1H. When the scan signal is supplied to the n-th scan line Sn−1, both of the third transistor M3 and the fifth transistor M5 are turned on. Because the fifth transistor M5 is turned on, the fourth transistor M4 is diode-connected. Because the fourth transistor M4 is diode-connected, a voltage value obtained by subtracting a threshold voltage of the fourth transistor M4 from the first power supply ELVDD, is applied to the second node N2. Here, because a voltage value of the first power supply ELVDD is set to the third node N3, a voltage corresponding to the threshold voltage of the fourth transistor M4 is charged in a first capacitor C1. Furthermore, because the third transistor M3 is turned on, the first node N1 is electrically coupled with the first power supply ELVDD. Accordingly, a voltage corresponding to the threshold voltage of the fourth transistor M4 is charged in a second capacitor C2. Also, while the scan signal is being supplied to the (n−1)th scan line, since the first transistor M1 and the second transistor M2 are off, data signals VD and ID being supplied to the data line Dm, are not supplied to the pixel 140.

During the horizontal period 1H, the scan signal is supplied to the n-th scan line Sn to turn-on both the first transistor M1 and the second transistor M2. When the first transistor M1 is turned on, a voltage data signal VD supplied to the data line Dm, is supplied to the first node N1. Accordingly, a voltage of the first node N1 drops from a voltage of the first power supply ELVDD to a voltage of the voltage data signal VD. At this time, because the second node N2 is in a floating state, a voltage value of the second node N2 drops corresponding to a voltage drop of the first node N1. When the same capacity is set to the first capacitor C1 and the second capacitor C2, a voltage of the second node N2 drops by about half of the voltage drop of the first node N1. For example, when the first node N1 voltage drops by about 2V, the voltage of the second node N2 drops by about 1V.

The third node N3 maintains a voltage value of the first power supply ELVDD. Accordingly, a predetermined voltage corresponding to a difference between a voltage of the second node N2 and a voltage of the third node N3, is charged across the first capacitor C1. Since the first power supply ELVDD always maintains a uniform value, a voltage charged across the first capacitor C1 is determined by the voltage data signal VD. Additionally, a voltage corresponding to a voltage difference between the first node N1 and the second node N2, is charged across the second capacitor C2.

After a voltage corresponding to the voltage data signal VD has been charged across the first capacitor C1 and the second capacitor C2, a current corresponding to the current data signal ID is supplied to the data driver 120 via the data line Dm during the second period of the horizontal period 1H. The current corresponding to the current data signal ID is supplied to the data driver 120 through the first power supply ELVDD, the fourth transistor M4, and the second transistor M2. In response to the current data signal ID a voltage corresponding to the current data signal ID is charged in the first capacitor C1 and the second capacitor C2.

That is, during the first period, the voltage data signal VD is supplied to first charge a voltage in the first capacitor C1 and the second capacitor C2. Then, during the second period, the current data signal ID is supplied to control the voltage charged in the first capacitor C1 and the second capacitor C2 to a desired voltage. Since the data line is charged during the first period so as to turn on the fourth transistor M4, the charged voltage of the first capacitor C1 and the second capacitor C2 can be stably controlled using the current data signal ID during the second period. That is a voltage is charged at the second node N2 corresponding to the current data signal ID.

After the horizontal period 1H the scan signal is removed from the n-th scan line Sn to turn off both the first transistor M1 and the second transistor M2.

Figure 5:
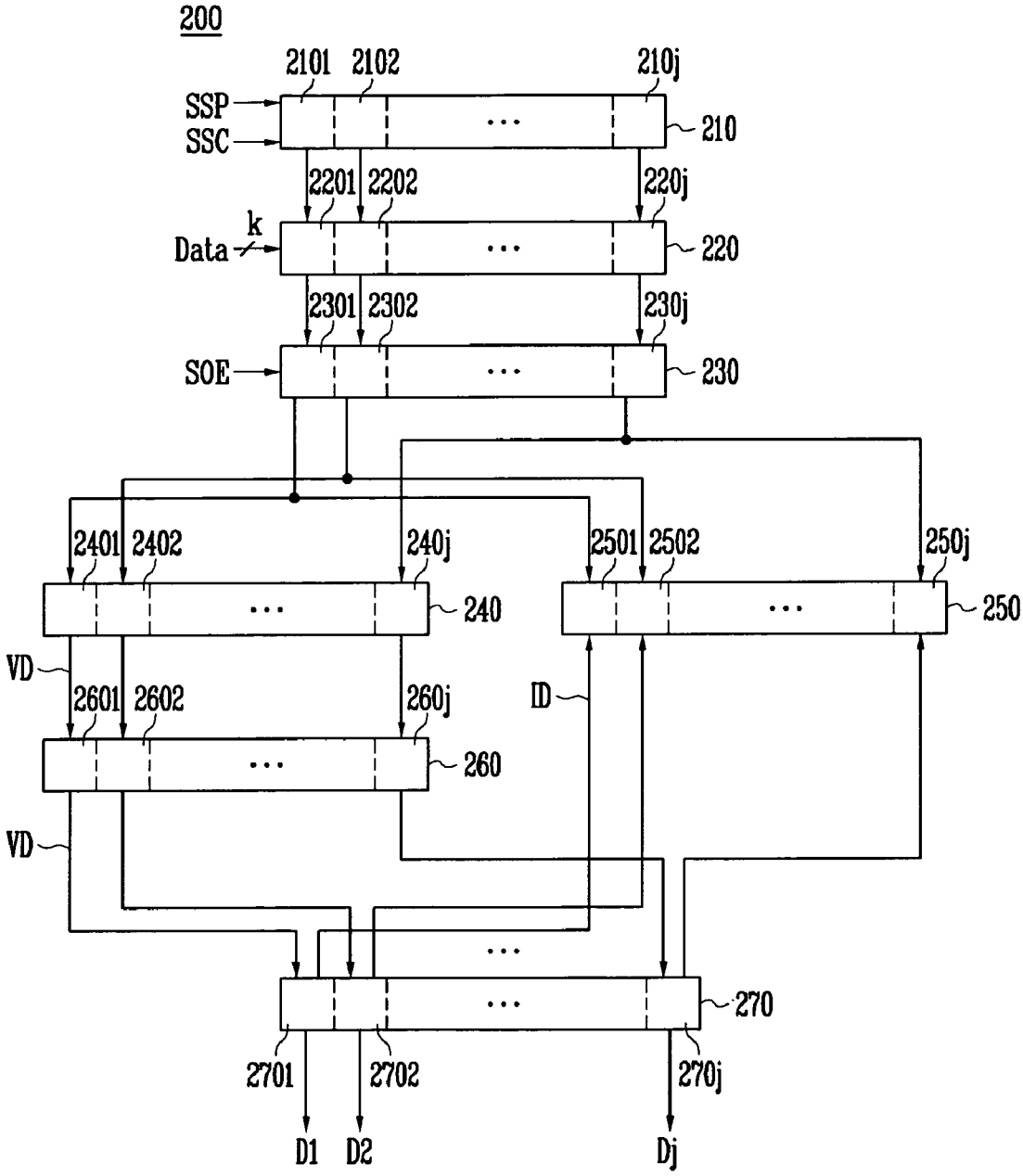
FIG. 5 is a block diagram showing an example of a data driving circuit shown in FIG. 2.

FIG. 5 is a block diagram showing an example of a data driving circuit shown in FIG. 2. In order to help convenience of the description, in FIG. 5, it is assumed that the data driving circuit 200 has j (j is a positive integer greater than 2) channels.

Referring to FIG. 5, the data driving circuit 200 includes a shift register 210, a sampling latch 220, a holding latch 230, a VDAC 240, an IDAC 250, a buffer unit 260, and a selection block 270. The shift register 210 sequentially generates a sampling signal. The sampling latch 220 sequentially stores data Data in response to the sampling signal. The holding latch 230 temporarily stores the data Data of the sampling latch 220 and supplies the stored data Data to a voltage digital-analog converter (VDAC) 240 and a current digital-analog converter (IDAC) 250. The VDAC 240 generates a voltage data signal VD corresponding to a gray scale level value of the data Data. The IDAC 250 generates a current data signal ID corresponding to a gray scale value of the data Data. The buffer unit 260 supplies the voltage data signal VD. The selection block 270 couples the data lines D1 through Dj to the buffer unit 260 during a first period of a horizontal period, and couples the data lines D1 through Dj to the IDAC 250 during a second period of a horizontal period, as discussed in reference to FIG. 4.

The shift register 210 receives a source shift clock SSC and a source start pulse SSP from the timing controller 150. When the shift register 210 receives a source shift clock SSC and a source start pulse SSP, it sequentially generates j sampling signals while shifting the source start pulse SSP each period of the source shift clock SSC. In order to do this, the shift register 210 includes j shift registers 2101 to 210j.

The sampling latch 220 sequentially stores data Data in response to the sampling signals sequentially supplied from the shift register section 210. The sampling latch section 220 includes j sampling latches 2201 to 220j for storing j data Data. Furthermore, each of the sampling latches 2201 to 220j has a size corresponding to the bit number of the data Data. For example, when the data Data is formed by k bits, the sampling latches 2201 to 220i are set to have k bit size.

When a source output enable signal SOE is input to the holding latch section 230, the holding latch 230 receives and stores the data Data from the sampling latch section 220. Moreover, when a source output enable signal SOE is input to the holding latch 230, the holding latch 230 supplies data Data stored therein to the VDAC 240 and the IDAC 250. So as to perform this operation, the holding latch 230 includes j holding latches 2301 to 230j each having k bits.

The VDAC 240 generates a voltage data signal VD in response to a bit value of the data Data, and provides the voltage data signal VD to the selection block 270 through the buffer unit 260. In order to do this, the VDAC 240 includes j voltage generators 2041 to 240j. In some embodiments, the VDAC 240 may directly supply the voltage data signal VD to the selection block 270 without it going via the buffer unit 260.

The IDAC 250 generates a current data signal ID corresponding to a bit value of the data Data, and provides the current data signal ID to pixels 140 via the selection block 270. Namely, the IDAC 250 sinks a current corresponding to the current data signal ID from the pixels 140 in response to the bit value of the data Data. So as to do that, the IDAC 250 includes j current generators 2501 to 250j.

The buffer unit 260 provides the voltage data signal VD supplied from the VDAC 240 to the selection block 270. In order to perform the function, the buffer unit 260 includes j buffers 2601 to 260j.

The selection block 270 couples the data lines D1 through Dj to the VDAC 240 through the buffer unit 260 during a first period of a horizontal period 1H, and couples the data lines D1 through Dj to the IDAC 250 during a second period of the horizontal period 1H, as shown in FIG. 4. Accordingly, the voltage data signal VD is provided to pixels 140 selected by a scan signal via the data lines D1 to Dj during the first period of the horizontal period 1H. Moreover, a current corresponding to a current data signal ID from the pixels 140 selected by the scan signal, is provided to the IDAC 250 via the data lines D1 to Dj during the second period of the horizontal period 1H. So as to perform the operation, the selection block 270 includes j selectors 2701 to 270j.

Figure 6:
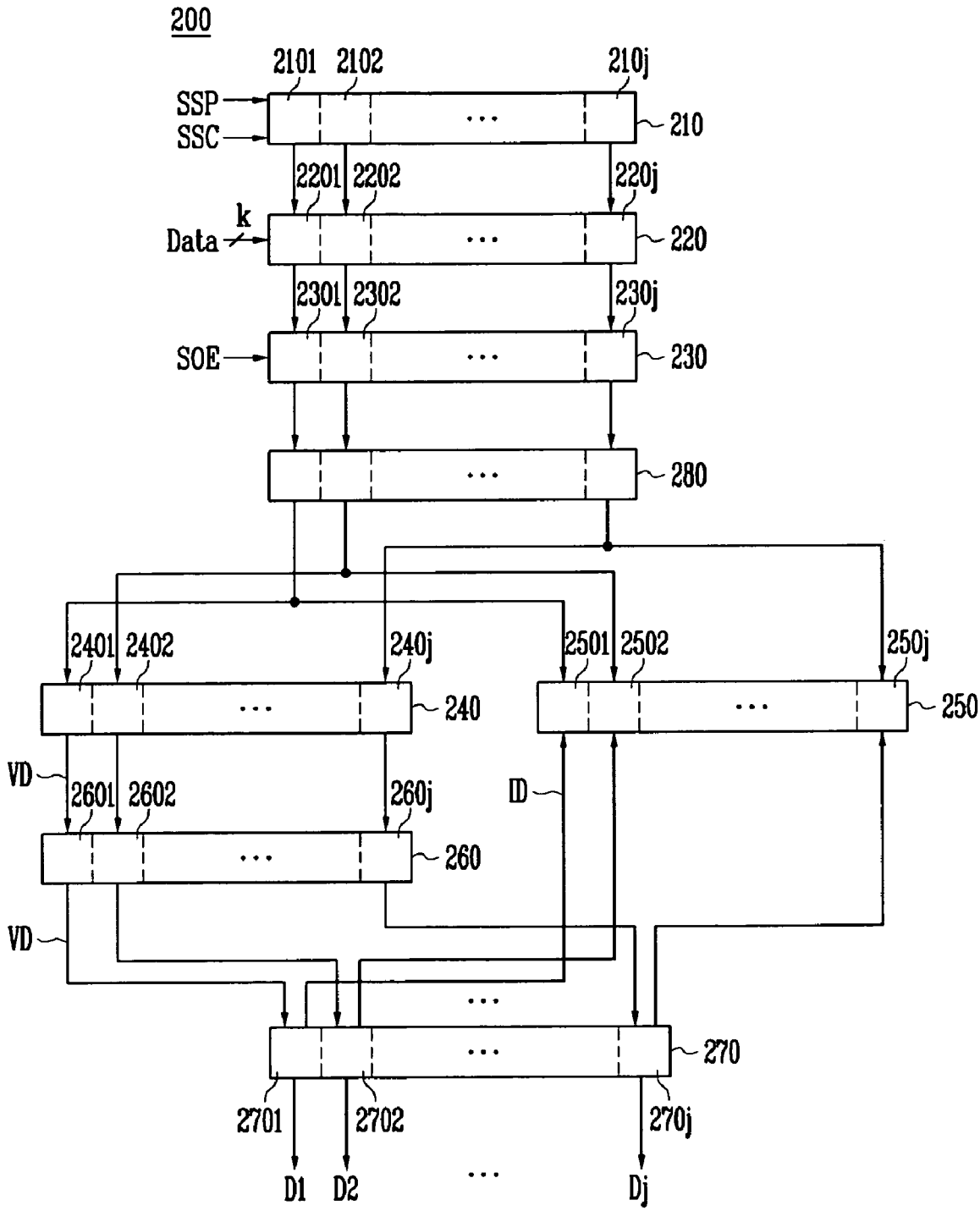
FIG. 6 is a block diagram showing another example of a data driving circuit shown in FIG. 2.

As shown in FIG. 6, the data driving circuit 200 can further include a level shifter 280 between the holding latch section 230 and the DACs, VDAC 240 and IDAC 250.The level shifter 280 increases the data voltage levels of the data DATA from the holding latch section 230, and provides the data of increased voltage level to the VDAC 240 and the IDAC 250. When data Data having a higher voltage level from an external system is supplied to the data driving circuit 200, more expensive circuit elements, which tolerate the higher voltage level must be used. This increases the cost of manufacturing. Therefore, in some embodiments, data Data having a lower voltage level is supplied to the data driving circuit 200, which boosts the data with the level shifter 280 for the ADC's which use the higher voltage.

Figure 7:
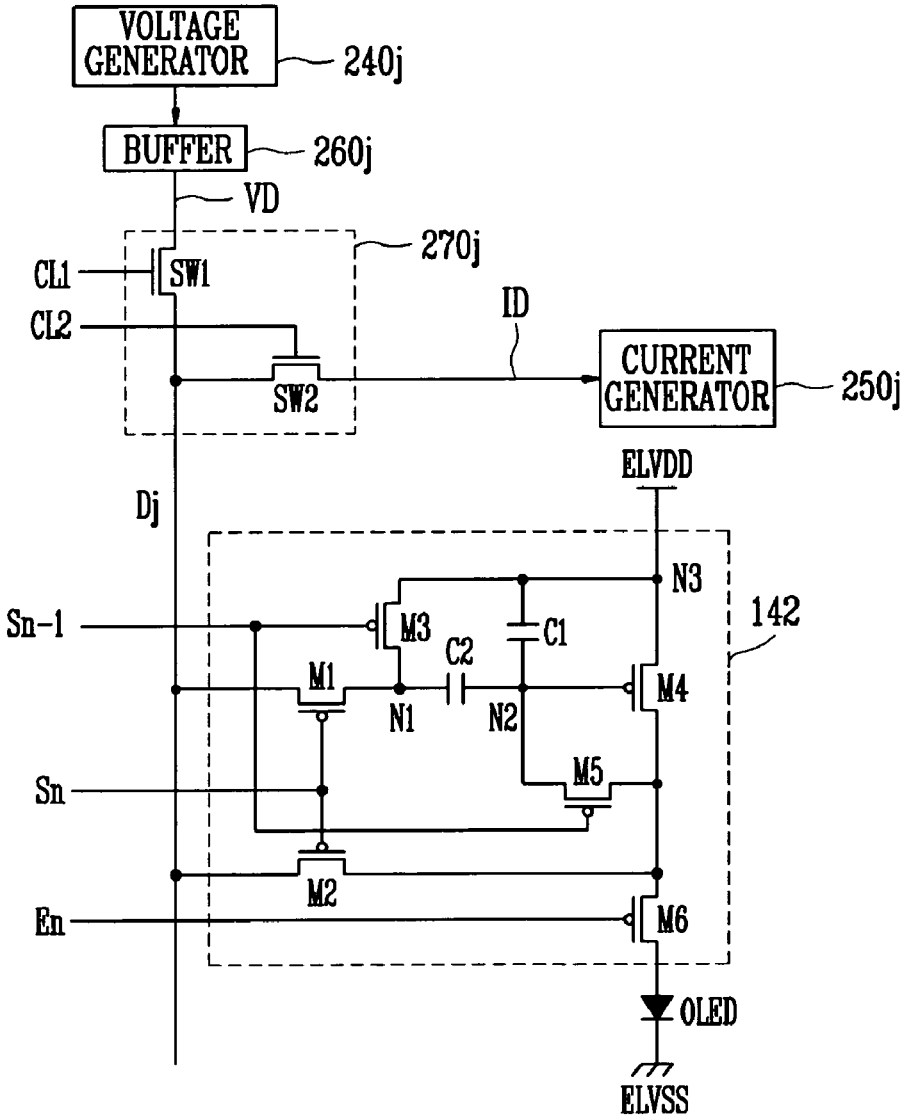
FIG. 7 is a schematic view showing the connected structures of the voltage generator, the current generator, the selector, and the pixel shown in FIG. 5 and FIG. 6.

FIG. 7 is a schematic view showing the connected structures of embodiments of the voltage generator, the current generator, the selector, and the pixel shown in FIG. 5 and FIG. 6. A j-th voltage generator 240j and a j-th current generator 250j are shown in FIG. 7. The selector 270j includes a first switch SW1 and a second switch SW2. The first switch SW1 is connected between the voltage generator 240j and the data line Dj. The second switch SW2 is connected between the current generator 250j and the data line Dj.

Figure 8:
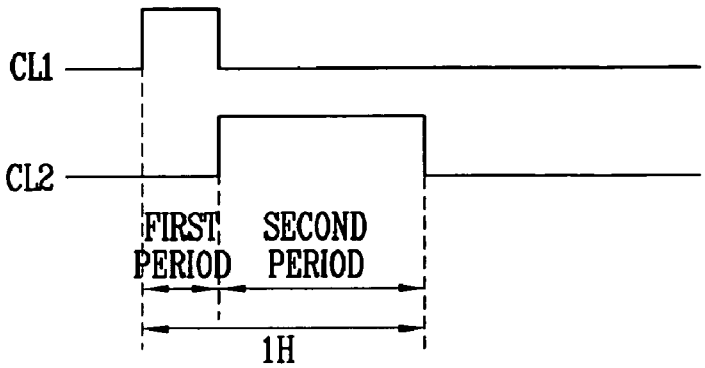
FIG. 8 is a timing chart for illustrating a selection signal supplied from the switches shown in FIG. 7.

As shown in FIG. 8, the first switch SW1 is turned on for the first period of horizontal period 1H by a first selection signal supplied from a first control line CL1. That is, while the voltage data signal VD is supplied to the data line Dj, the first switch SW1 is turned on. The second switch SW2 is turned on for the second period during 1 horizontal period 1H according to a second selection signal supplied from a second control line CL1. That is, while the current data signal ID from the pixel 142 is sunk through the data line Dj, the second switch SW2 is turned on.

The voltage generator 240j outputs a voltage (namely, voltage data signal VD) according to a gray scale value of the data Data supplied thereto. While the first switch SW1 is turned on, the voltage data signal VD output from the voltage generator 240j is supplied to the data line Dj.

The current generator 250j is formed as a current sink. Accordingly, the current generator 250j receives a current (namely, current data signal ID) from the pixel 140 corresponding to a gray scale value of data Data supplied thereto. While the second switch SW2 is turned on, the current generator 250j receives the current data signal ID from the pixel 142 through the data line Dj.

Operation of the present invention will be now explained with reference to FIG. 4, FIG. 7, and FIG. 8. First, while a scan signal is being supplied to the (n−1) th scan line Sn−1, a voltage corresponding to a threshold voltage of the fourth transistor M4 is charged in the first capacitor C1 and the second capacitor C2. Next, the scan signal is supplied to the n-th scan line Sn so as to turn-on the first transistor M1 and the second transistor M2. In addition, the first switch SW1 is turned on. Because the first switch SW1 is turned on, the voltage data signal VD generated by the voltage generator 240j is provided to the first node N1 through a buffer 260j, the first switch SW1, and the first transistor M1. In response, a voltage corresponding to a difference between the first power supply ELVDD and the voltage data signal VD is charged across the first capacitor C1 and the second capacitor C2.

Then, during a second period of the horizontal period 1H, the second switch SW2 is turned on. Because the second switch SW2 is turned on, a current (current data signal ID) is provided to a current generator 250j from the first power supply ELVDD, through the fourth transistor M4, the second transistor M2, and the data line Dj. Consequently, a voltage corresponding to the current data signal ID is charged across the first capacitor C1.

Figure 9:
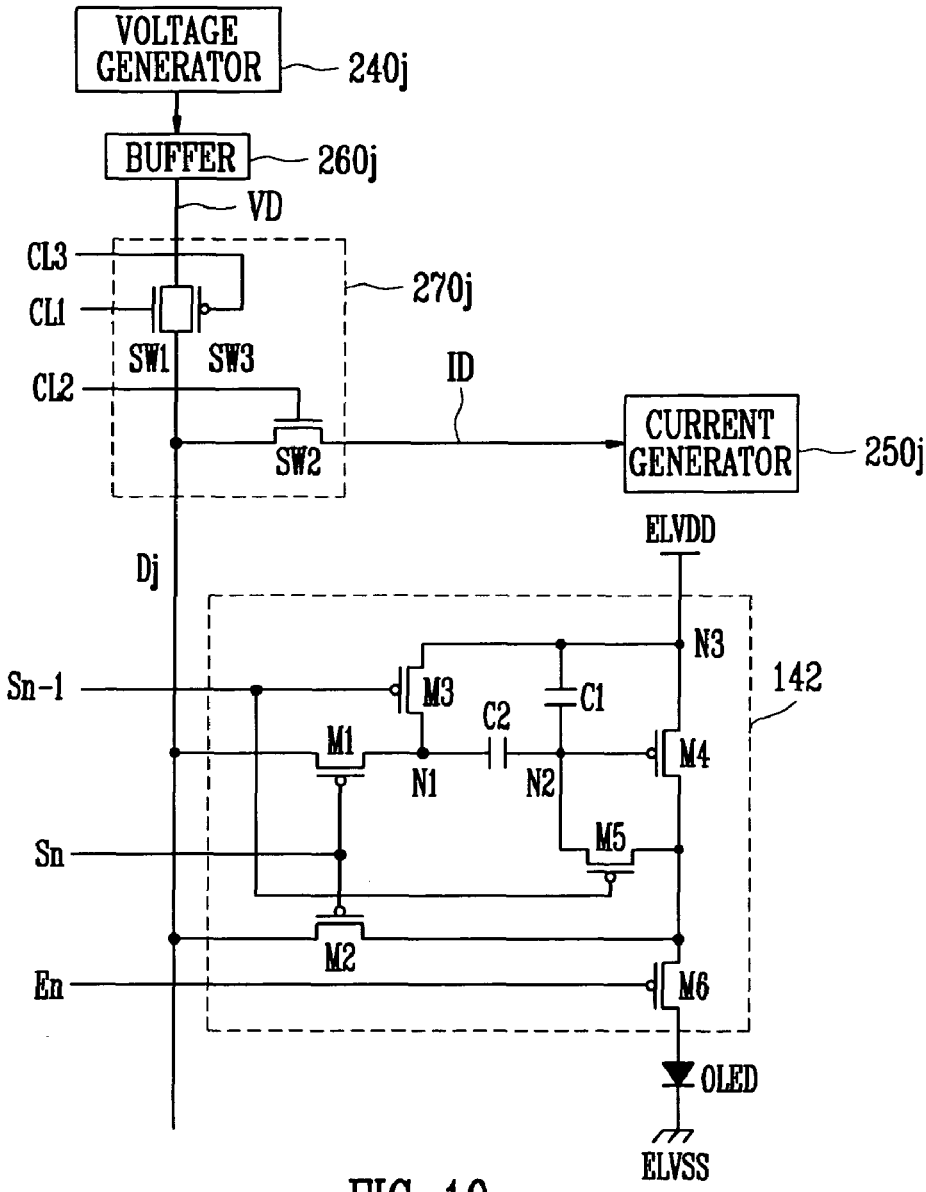
FIG. 9 is a schematic view showing another example of the selector shown in FIG. 7.
Figure 10:
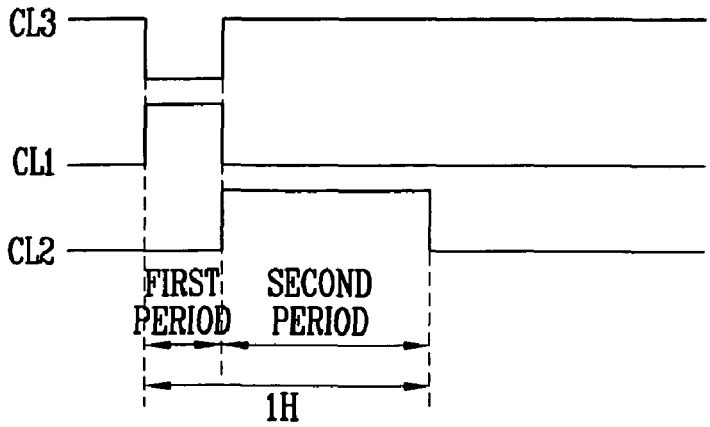
FIG. 10 is a timing chart for illustrating a selection signal supplied from the switches shown in FIG. 9.

Thereafter, the sixth transistor M6 is turned on by applying a signal to emission control line En. Accordingly, the current is supplied from the fourth transistor M4 to the organic light emitting diode OLED. The supplied current corresponds to the voltage charged across the first capacitor C1, which corresponds to the current data signal ID. Accordingly, the current to and therefore the luminance of the organic light emitting diode OLED corresponds to the current data signal ID. Because the current data signal ID is essentially indentical and independent of pixel position within the array, luminance across the array is substantially uniform. The switches SW1 and SW2 can have other configurations. For example, a configuration as shown in FIG. 9 may be used. In this embodiment, the first switch SW1 and a third switch SW3 can be coupled in a transmission gate form. Here, the first switch SW1 is an NMOS transistor, and is coupled with the first control line CL1. The third switch SW3 is a PMOS transistor, and is coupled with the third control line CL3. In this embodiment, as shown in FIG. 10, a first selection signal supplied from the first control line CL1 and a third selection signal supplied from the third control line CL3, have opposite polarities. Consequently, the first and third switches SW1 and SW3 are turned on and turned off at substantially the same time. An advantage of using a transmission gate configuration is that the resistance of such a switch remains low enough for effective transmission across a wider range of voltages.

Although various embodiments of the present invention have been shown and described, it will be appreciated by those skilled in the art that changes might be made in this embodiment without departing from the principles and spirit of the invention.

As mentioned above, according to embodiments of the pixel and organic light emitting display using the pixel disclosed herein, a voltage is supplied to data lines during a first period of a horizontal period, and current from the data lines is sunk during a second period. Here, at least one capacitor included in a pixel is first charged during the first period, and recharged during the second period, which allows a desired voltage to be charged across the capacitor. That is, since a charged voltage across the at least one capacitor for each of the pixels is controlled using a current of a uniform value, uniform luminescence may be achieved across the display.

What is claimed is:

1. An organic light emitting display, comprising a plurality of pixels;

a scan driver configured to supply a scan signal to scan lines; and at least one data driving circuit configured to supply a voltage data signal during a first period of at least one horizontal period, the voltage data signal being supplied through data lines to the pixels selected by the scan signal, the driving circuit being further configured to provide a current data signal to the pixels during a second period different from the first period, wherein each of the pixels comprise:

an organic light emitting diode; and a pixel circuit electrically connected to at least one of the scan lines and to at least one of the data lines, the pixel circuit including:

a drive transistor, configured to supply current to the organic light emitting diode, and a first capacitor, wherein the data driving circuit is configured to charge the first capacitor with a voltage corresponding to a difference between the first power supply and the voltage data signal and to charge the first capacitor with a voltage corresponding to the current of the current data signal flowing through the drive transistor, wherein the pixel circuit is configured to control the amount of current supplied to a second power supply from the first power supply through the organic light emitting diode according to the voltage charged across the first capacitor;

first and second transistors connected to at least one data line, and configured to turn on in response to a scan signal supplied to an n (n is a positive integer)-th scan line;

a third transistor electrically connected to the first power supply and to a second electrode of the first transistor, the third transistor being configured to turn on in response to the scan signal supplied to an (n−1) th scan line;

a second capacitor connected to the first transistor, wherein the drive transistor co mprises a gate connected to a common terminal of the first and second capacitors, and a first electrode connected to the first power supply; and a fifth transistor connected to the gate and the second electrode of the drive transistor, configured to diode-connect the drive transistor in response to the scan signal supplied to the (n−1) th scan line.

2. The organic light emitting display as claimed in claim 1, wherein the second transistor is connected to the second electrode of the fourth transistor and is connected to the data lines, and wherein the second transistor is configured to provide a current path for the current signal.

3. The organic light emitting display as claimed in claim 1, wherein a sixth transistor is connected to the second electrode of the fourth transistor and is connected to the organic light emitting diode, and is configured to turn off in response to the scan signal supplied to the (n−1) th and n th scan lines.

4. The organic light emitting display as claimed in claim 1, wherein the data driving circuit includes:

a voltage output digital-analog converter configured to generate the first data signal, wherein the first data signal corresponds to a gray scale of externally supplied data;

a current output digital-analog converter configured to generate the second data signal, wherein the second data signal corresponds to the gray scale of the data; and a selection block configured to electrically connect the voltage output digital-analog convert with the data lines for the first period during the horizontal period, and to electrically connect the current output digital-analog converter with the data lines during the second period.

5. The organic light emitting display as claimed in claim 4, wherein the selection block comprises a plurality of selectors, each selector comprising:

a first switch element electrically connected to the voltage output digital-analog converter and to the data lines, the first switch element configured to turn on during the first period and to turn off during the second period; and a second switch element electrically connected to the current output digital-analog converter and to the data lines, on the second switch element configured to turn on during the second period and to turn off during the first period.

6. The organic light emitting display as claimed in claim 5, further comprising a third switch element formed by a transistor having a conductive type different from of that of the first switch element, wherein the third switch element is electrically connected to the first and second electrodes of the first switch element, and configured to turn on and turn off substantially simultaneously with the first switch element.

7. The organic light emitting display as claimed in claim 4, further comprising a buffer unit electrically connected to the voltage output digital-analog converter and to the selection block.

8. The organic light emitting display as claimed in claim 4, further comprising a shift register configured to sequentially generate a sampling signal; and a latch section configured to store the data in response to the sampling signal from the shift register, and configured to supply the stored data to the voltage output digital-analog converter and to the current output digital-analog converter.

9. The organic light emitting display as claimed in claim 8, wherein the latch section includes:

a sampling latch configured to sequentially store the data in response to the sampling signal; and a holding latch configured to store the data stored in the sampling latch, and to supply the stored data to the voltage output digital-analog converter and the current output digital-analog converter.

10. The organic light emitting display as claimed in claim 9, further comprising a level shifter configured to increase a voltage level of the data stored in the holding latch and to supply the increased level data to the current output digital-analog converter.

11. The organic light emitting display as claimed in claim 1, wherein the pixel circuit is further configured to control the amount of current supplied to through the organic light emitting diode according to an emission control signal separate from the scan signal.

* * * * *